US006302809B1

(12) United States Patent
Yiu

(10) Patent No.: US 6,302,809 B1
(45) Date of Patent: Oct. 16, 2001

(54) NOISE REDUCTION DART BOARD

(76) Inventor: Chih-Hao Yiu, 7-1 Floor, No. 30, Lin Sen Rd., Taichung City (TW)

( * ) Notice: Subject to any disclaimer, the term of this patent is extended or adjusted under 35 U.S.C. 154(b) by 0 days.

(21) Appl. No.: 09/566,964

(22) Filed: May 9, 2000

(51) Int. Cl.[7] ..... F41J 5/04
(52) U.S. Cl. ..... 473/376
(58) Field of Search ..... 473/371–377, 473/403, 404, 408

(56) References Cited

U.S. PATENT DOCUMENTS 6,047,968 * 4/2000 Lu et al. ..... 273/371
6,089,571 * 7/2000 Cho ..... 273/374
6,116,607 * 9/2000 Cho ..... 273/374

* cited by examiner

*Primary Examiner*—Mark S. Graham
(74) *Attorney, Agent, or Firm*—Charles E. Baxley

(57) ABSTRACT

A dart board includes a frame with ring members and ribs connected within the frame so as to define partitions between the ring members and the ribs. A post extends from each connection point of the ring members and the ribs and a noise absorbing member is mounted to each post. A target unit is movably retained in each partition and each corner of the target unit is guided along the posts so that when the target unit is hit by a dart, the target unit moves silently along the noise absorbing members on the posts. An electric circuit plate is located on a rear side of the target units and a base board is connected to the frame to position the electric circuit plate in position.

5 Claims, 4 Drawing Sheets

NOISE REDUCTION DART BOARD

FIELD OF THE INVENTION

The present invention relates to a dart board that has noise reduction members mounted to guide posts of the dart board so that when a dart hits on a unit of one score ring, the unit is moved and the noise reduction members between the unit reduces the noise.

BACKGROUND OF THE INVENTION

A conventional dart board that can illustrate scores generally includes a circular frame within which a plurality of rings are located and the rings are connected by radial ribs. A plurality of partitions are defined between adjacent two rings. Each partition receives a unit which is moved in the partition and guided by posts extending from the cross-point of the rings and the radial ribs. An electric plate is located on a rear side of the units so that when a dart hits on a unit, the unit is pushed by the dart and moves to compress sensors on the electric plate to show the scores of the unit represents. Because the units are movably engaged in the partitions between the rings and the radial ribs so that when the dart hits the dart board, vibration will shake the units so that noise will generate. The noise affects the sound when the dart penetrates into the unit and the sound generated by penetrating of the dart is one of important factors that players appreciate.

The present invention intends to provide a dart board that reduces the noise of the movement of the units in the partitions when a dart hits the dart board.

SUMMARY OF THE INVENTION

In accordance with one aspect of the present invention, there is provided a dart board comprising a frame having a central ring and a plurality of ribs extending radially from the central ring. A plurality of ring members are connected to the ribs and shares a common center of the central ring. A plurality of partitions are defined between the ribs and the ring members. Each partition has a target unit movably received therein and an electric circuit plate is located on a rear side of the target units. A base board is connected to the frame and positions the electric circuit plate and the target units between the base board and the frame. A plurality of posts respectively extend from connection points between the ring members and the ribs. Each post has a noise absorbing member mounted thereto and each target unit is movably retained by the noise absorbing members on the posts located on comers of each partition.

The object of the present invention is to provide dart board that has noise absorbing member mounted to posts of a frame, and each target unit is movably retained between the posts so that when the target unit is hit by a dart, the unit moves silently.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
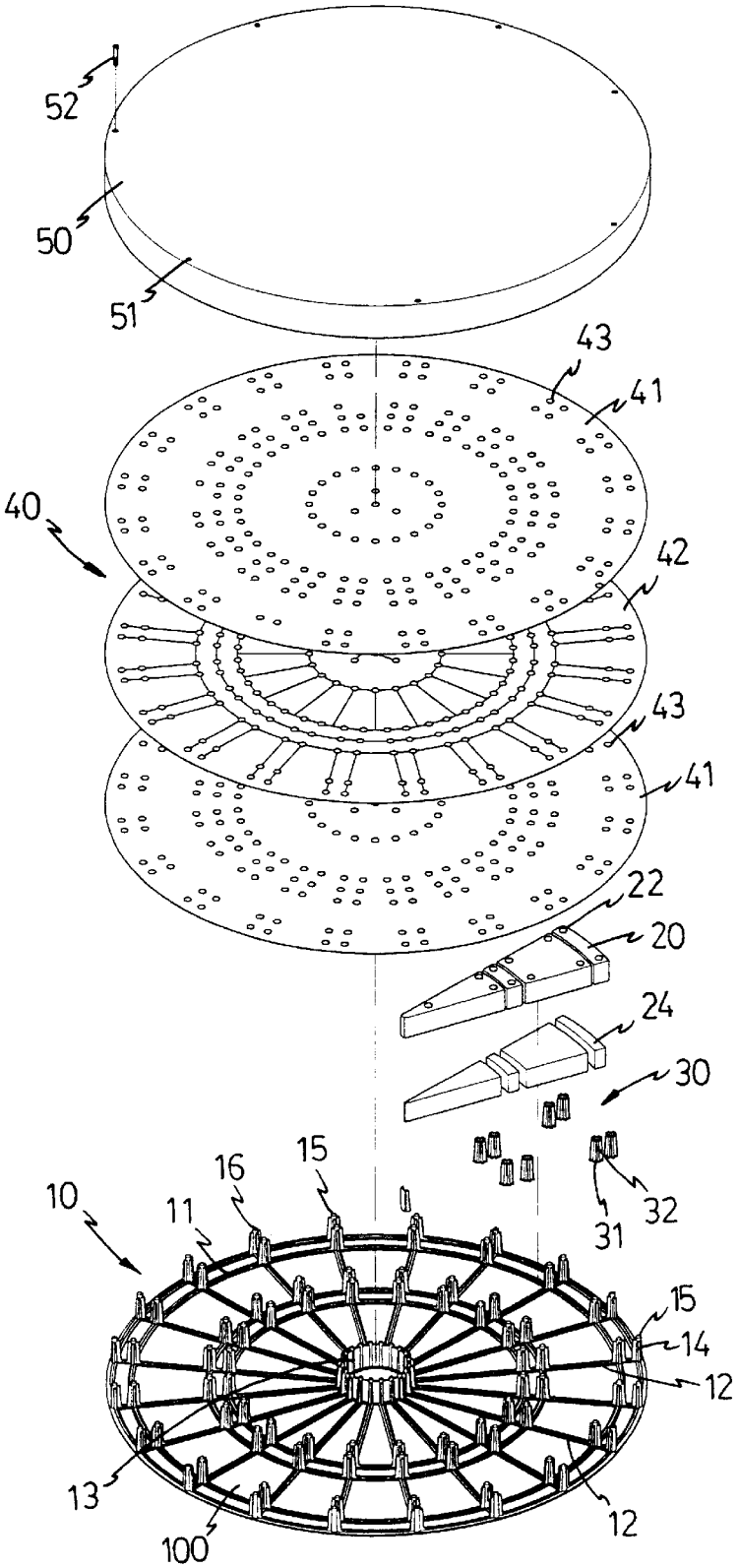
FIG. 1 is an exploded view to show a dart board with noise absorbing members of the present invention.
Figure 2:
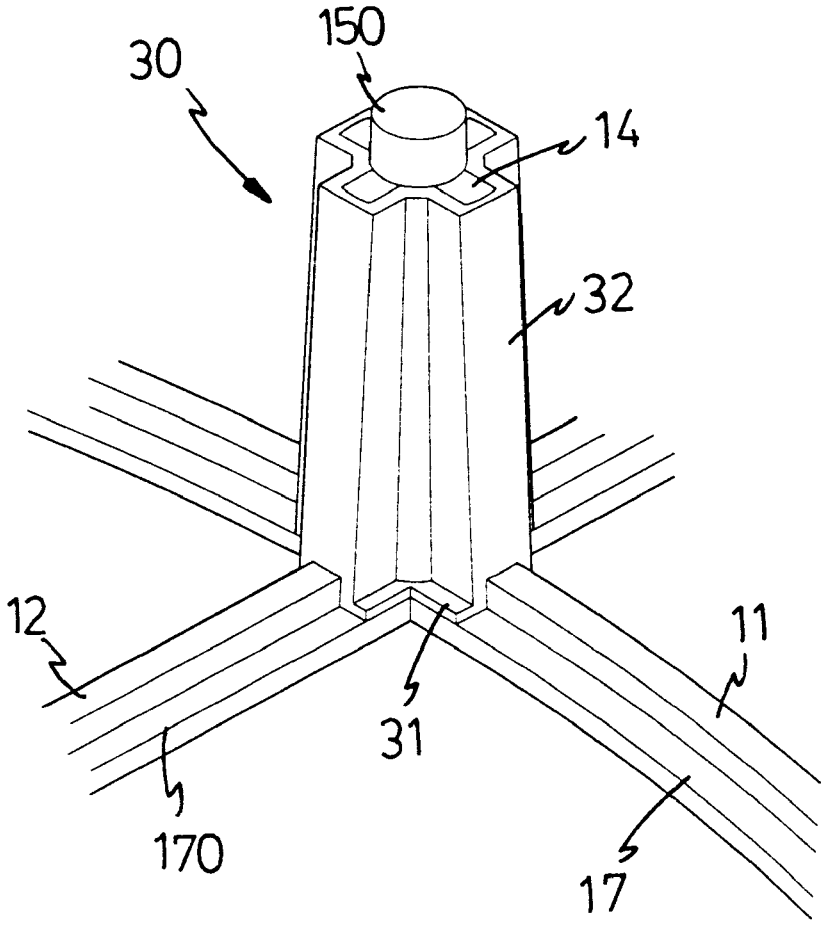
FIG. 2 is a perspective view to show a post with noise absorbing member mounted thereto.
Figure 3:
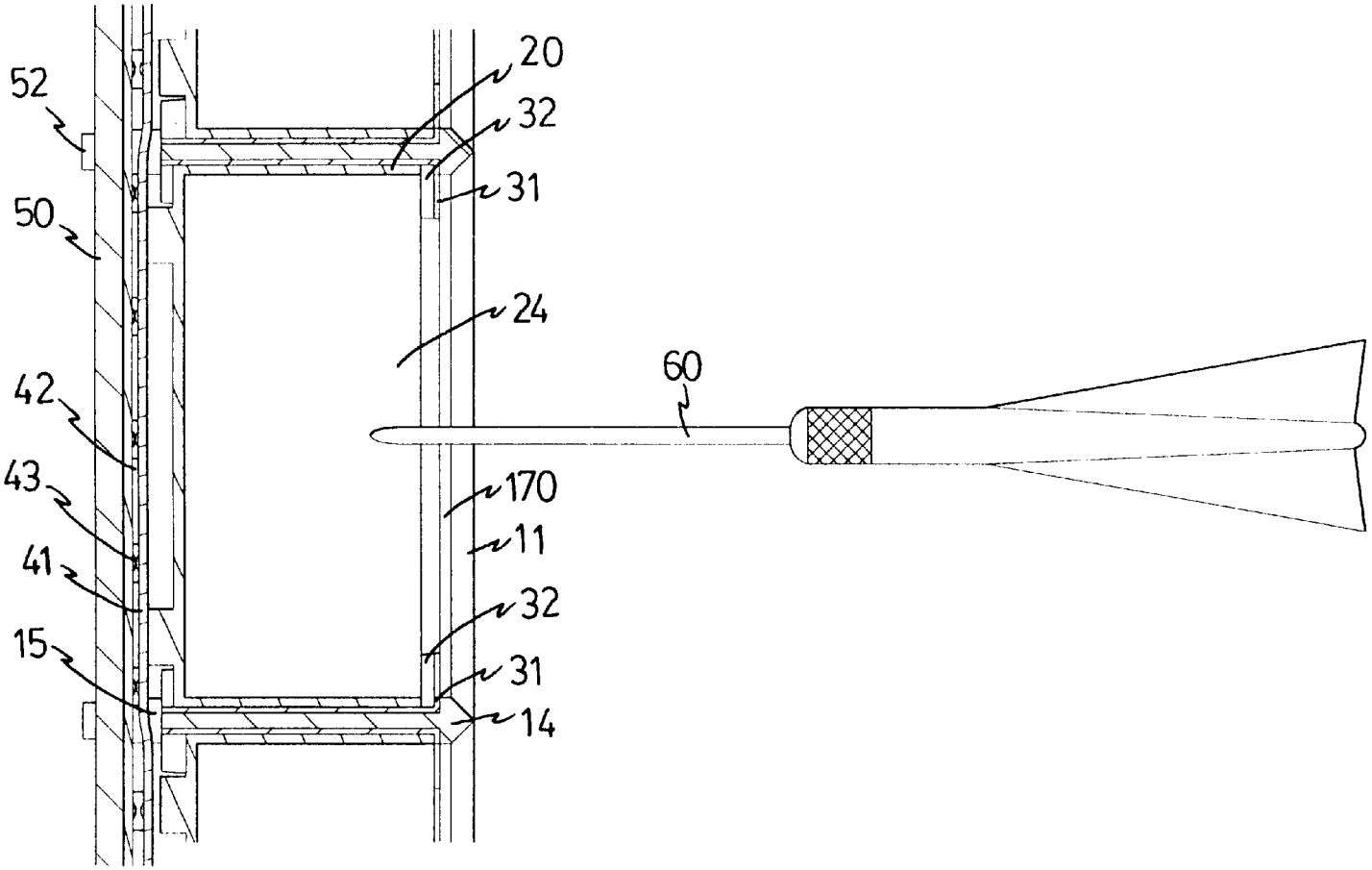
FIG. 3 is a side elevational view, partly in section, of the dart board and shows a dart hits one of the target unit to let the target unit moves.
Figure 4:
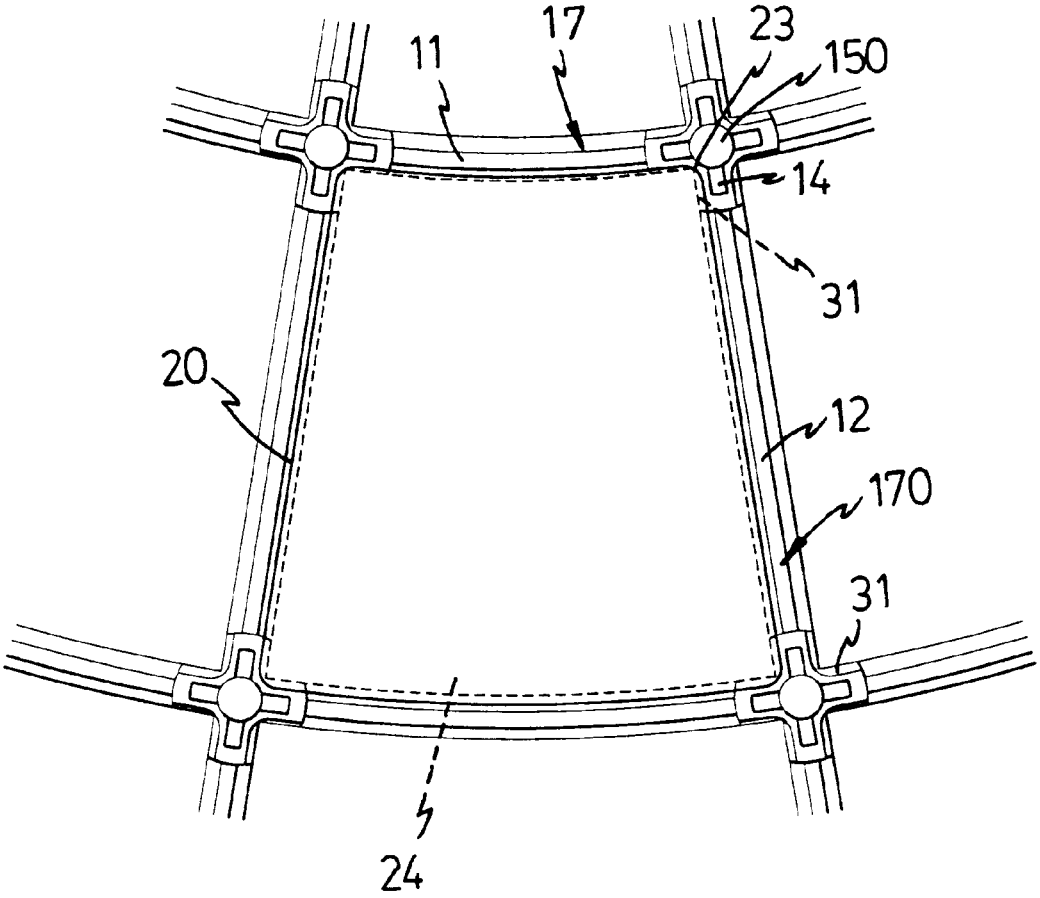
FIG. 4 is a plan view to show a target unit is retained between four posts of the frame of the present invention.

Referring to FIGS. 1 and 2, the dart board in accordance with the present invention comprises a circular frame 10 having a central ring 13 located at a center of the frame 10 and a plurality of ribs 12 extend radially from the central ring 13 and connected between the central ring 13 and the frame 10. A plurality of ring members 11 are connected to the ribs 12 and shares a common center of the central ring 13. A plurality of partitions 100 are defined between the ribs 12 and the ring members 11. A plurality of posts 15 respectively extend from connection points between the ring members 11 and the ribs 12. Referring to FIG. 3, each post 15 has a noise absorbing member 32 mounted thereto and a target unit 24 is movably retained by the noise absorbing members 32 on the posts 15 located on corners of each partition 100. A protrusion 150 extends from a top of each post 15.

Each of the ring members 11 has two side flanges 17 extending from two sides thereof, and each of the ribs 12 having two side flanges 170 extending from two sides thereof. Each post 15 has four flanges 14 extending outward from four sides thereof and the noise absorbing member 32 is mounted to the four flanges 14. Each noise absorbing member 32 has an extension portion 31 which is rest on the side flanges 17 and 170 of the ring members and the ribs 12. Therefore, each the target unit 24 contacts the extension portion 31.

An electric circuit plate assembly 40 is located on a rear side of the target units 24 and includes two flexible plates 41 between which an electric circuit plate 42 is located. Each of the two flexible plates 41 has a plurality of convex spots 43. A rear side of each target unit 24 is enclosed by a pushing member 20 which is located between the each target unit 24 and the electric circuit plate assembly 40. Each pushing member 29 has bosses 22 extending from a surface facing the electric circuit plate assembly 40 so that when the target 24 is hit by a dart 60 as shown in FIG. 3, the bosses 22 will touch contact points on the electric circuit plate 42 to close a circuit.

A base board 50 has a plurality of apertures 51 defined therethrough with which the protrusions 150 on the posts 15 are engaged. Screws 52 extend through the protrusions 150 and connects the base board 50 to the frame 10. The electric circuit plate assembly 40 and the target units 24 are then positioned between the base board 50 and the frame 10.

As shown in FIG. 3, the target unit 24 is moved when a dart 60 hits the target unit 24, because the corners of the target unit 24 are enclosed by the noise absorbing members 32 so that it will move silently. On the other hand, other target units 24 contact extension portions 31 of the noise absorbing members 32 so that even if they shake, noise is absorbed by the extension portions 31 and the noise absorbing members 32.

While we have shown and described various embodiments in accordance with the present invention, it should be clear to those skilled in the art that further embodiments may be made without departing from the scope and spirit of the present invention.

What is claimed is:

1. A dart board comprising:

a frame having a central ring located at a center of said frame, a plurality of ribs extending radially from said central ring and connected between said central ring and said frame, a plurality of ring members connected to said ribs and sharing a common center of said central ring, a plurality of partitions defined between said ribs and said ring members, a plurality of posts respectively extending from connection points between said ring members and said ribs, each post having a noise absorbing member mounted thereto and a target unit movably retained by said noise absorbing members on said posts located on corners of each partition, and an electric circuit plate located on a rear side of said target units, a base board connected to said frame, to position said electric circuit plate and said target units between said base board and said frame.

2. The dart board as claimed in claim 1, wherein each post has four flanges extending outward from four sides thereof and said noise absorbing member is mounted to said four flanges.

3. The dart board as claimed in claim 1 further comprising a protrusion extending from a top of each post and said base board having a plurality of apertures, said protrusions on said posts engaged with said apertures.

4. The dart board as claimed in claim 1, wherein each of said ring members has two side flanges extending from two sides thereof, each of said ribs having two side flanges extending from two sides thereof, each noise absorbing member having an extension portion which rests on said side flanges of said ring members and said ribs, each said target unit contacting said extension portion.

5. The dart board as claimed in claim 1 further comprising a pushing member located between said each target unit and said electric circuit plate, each pushing member having bosses extending from a surface facing said electric circuit plate.

* * * * *